US006732869B1

(12) United States Patent
Chao

(10) Patent No.: US 6,732,869 B1
(45) Date of Patent: May 11, 2004

(54) LOCATING STRUCTURE OF A PISTOL NOZZLE RACK

(76) Inventor: Hui-Chen Chao, 75, Liau Tsuoh Lane, Liau Tsuoh Li, Lu Kang Chen, Chang Hua Hsien (TW)

( * ) Notice: Subject to any disclaimer, the term of this patent is extended or adjusted under 35 U.S.C. 154(b) by 0 days.

(21) Appl. No.: 10/252,766

(22) Filed: Sep. 24, 2002

(51) Int. Cl.[7] ..... A47F 7/00
(52) U.S. Cl. ..... 211/70.6; 211/60.1; D6/469
(58) Field of Search ..... 211/70.6, 60.1, 211/70, 59.1; D6/469

(56) References Cited

U.S. PATENT DOCUMENTS 5,080,240 A * 1/1992 Williams ..... 211/70.6
D454,013 S * 3/2002 Wang ..... D6/469
6,398,045 B1 * 6/2002 Chao ..... 211/70.6 X
6,471,076 B1 * 10/2002 Chen ..... 211/70.6
6,508,369 B2 * 1/2003 Wang ..... 211/60.1

* cited by examiner

*Primary Examiner*—Robert W. Gibson, Jr.
(74) *Attorney, Agent, or Firm*—Charles E. Baxley

(57) ABSTRACT

A rack is designed to hold a plurality of pistol-type nozzles, each having a barrel which is provided at the top end with a nozzle, and at the bottom end with a connection portion and an adjustment knob. The rack comprises a top frame and a bottom frame. The top frame is provided with a plurality of through slots for holding the barrels of the pistol nozzles. The bottom frame is provided with a plurality of locating slots, each having a seat, a locating projection extending from the seat, and a confinement recess. The connection portion and the adjustment knob are located in the locating slot of the bottom frame such that the connection portion is seated on the seat, and that the locating projection is inserted into a center hole of the connection portion, and that the adjustment knob is confined in the confinement recess.

2 Claims, 4 Drawing Sheets

LOCATING STRUCTURE OF A PISTOL NOZZLE RACK

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pistol nozzle rack, and more particularly to a locating structure of the pistol nozzle rack.

BACKGROUND OF THE INVENTION

The conventional racks for holding the pistol nozzles are rather primitive in design in that they comprise a framework for holding a plurality of pistol nozzles in a disorderly manner. In light of the pistol nozzles being various in design, the conventional racks are not suitable for use in holding the pistol nozzle of a specific design.

BRIEF SUMMARY OF THE INVENTION

The primary objective of the present invention is to provide a rack which is designed to hold securely the pistol nozzle of a specific design.

In keeping with the principle of the present invention, the foregoing objective of the present invention is attained by the rack comprising a top frame, a bottom frame, and a plurality of support rods. The top frame and the bottom frame are horizontally disposed such that they are connected by the support rods. The top frame is provided with a plurality of long through slots parallel to one another. The bottom frame is provided with a plurality of locating slots, which are arranged in rows corresponding in location to the long through slots of the top frame. A plurality of pistol nozzles are held by the rack such that the barrel of each pistol nozzle is held in one of the long through slots, and that the connection portion of a bottom end of the barrel is located in one of the locating slots. The locating slots are provided with a seat and a confinement portion contiguous to the seat. The seat is provided with an upright locating projection. The bottom end of the barrel of the pistol nozzle is located in the locating slot in such a manner that the locating projection of the seat is inserted into a center hole of the connection portion of the bottom end of the barrel, and that an adjustment knob of the connection portion is confined in the confinement portion of the locating slot.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
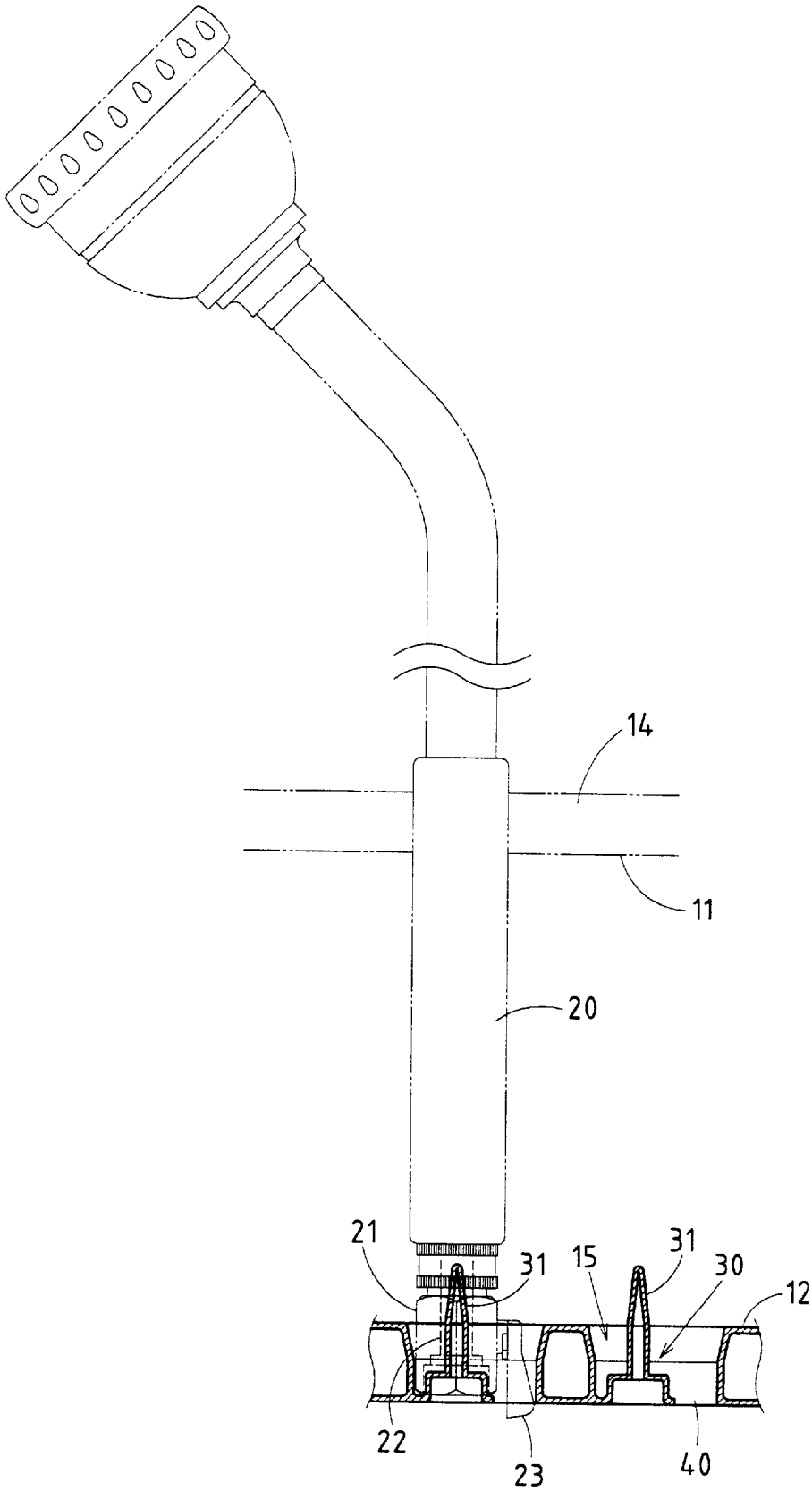
FIG. 1 shows a longitudinal sectional view of the preferred embodiment of the present invention.
Figure 2:
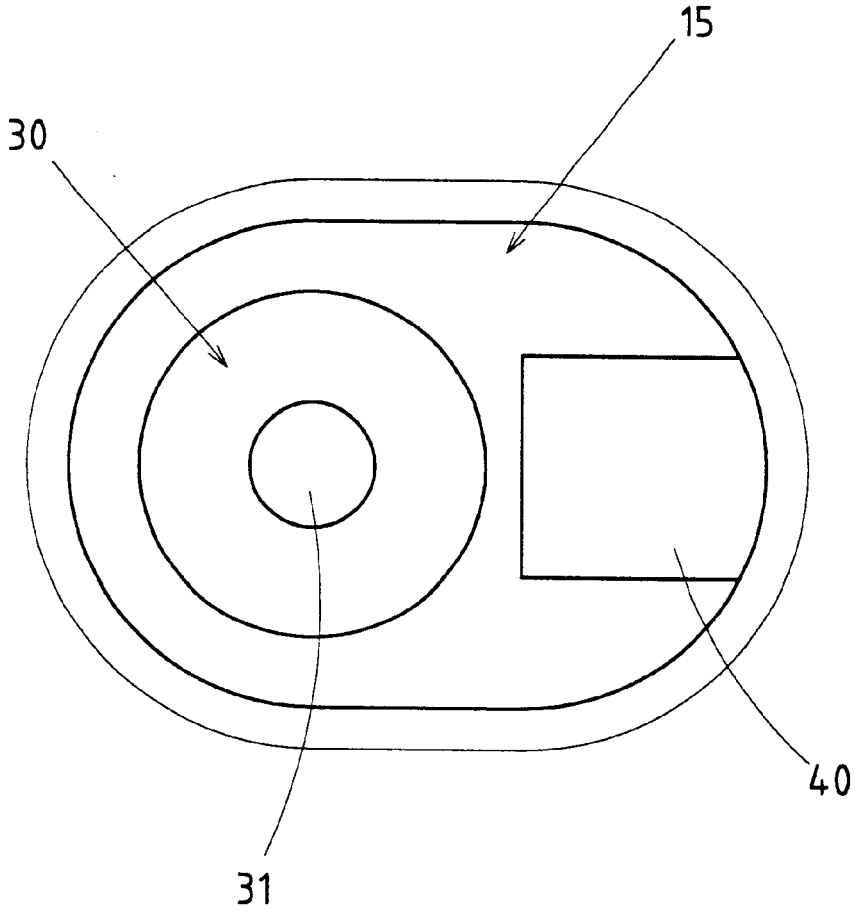
FIG. 2 shows a top plan view of the locating slot of the preferred embodiment of the present invention.
Figure 3:
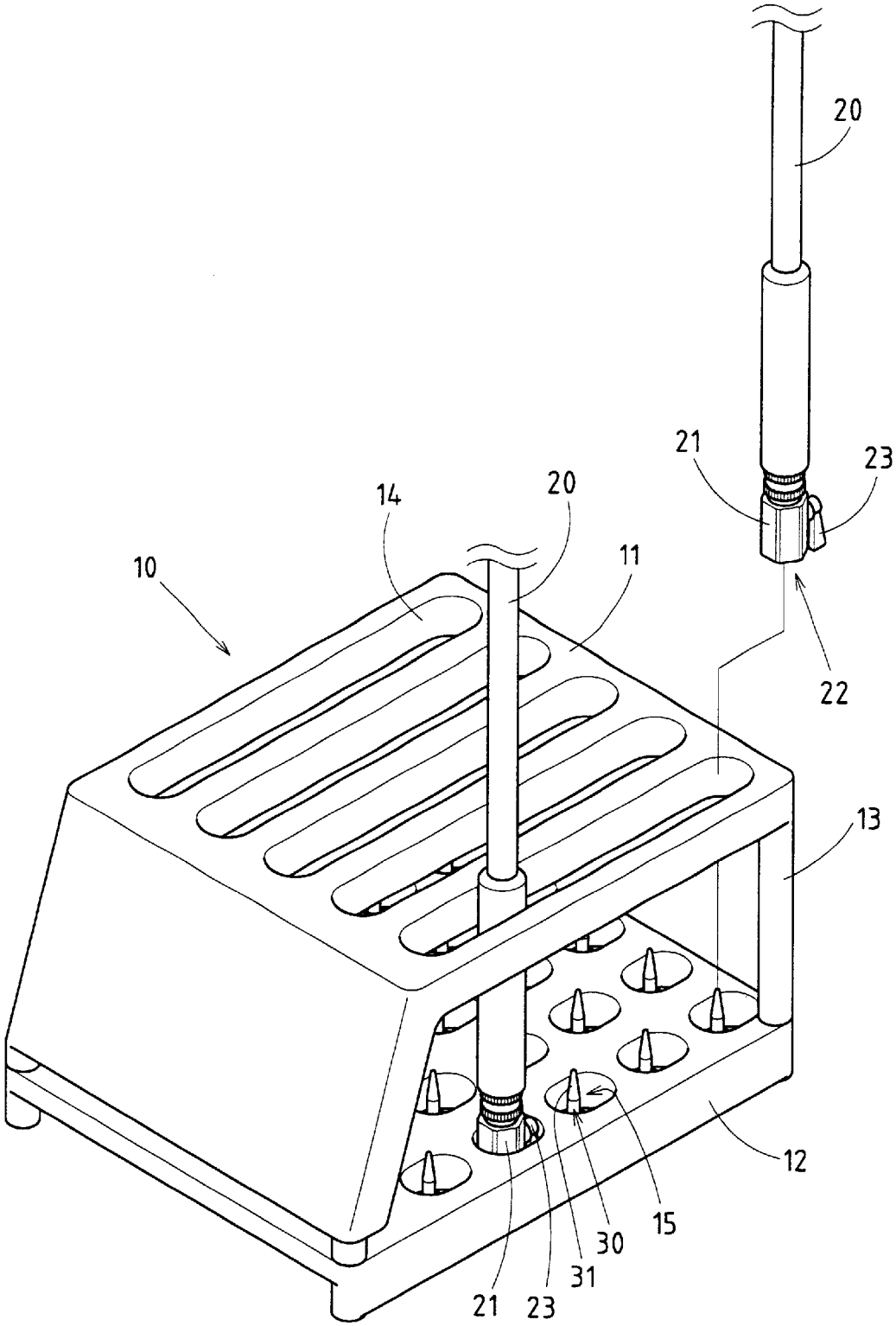
FIG. 3 shows a schematic perspective view of the preferred embodiment of the present invention at work.
Figure 4:
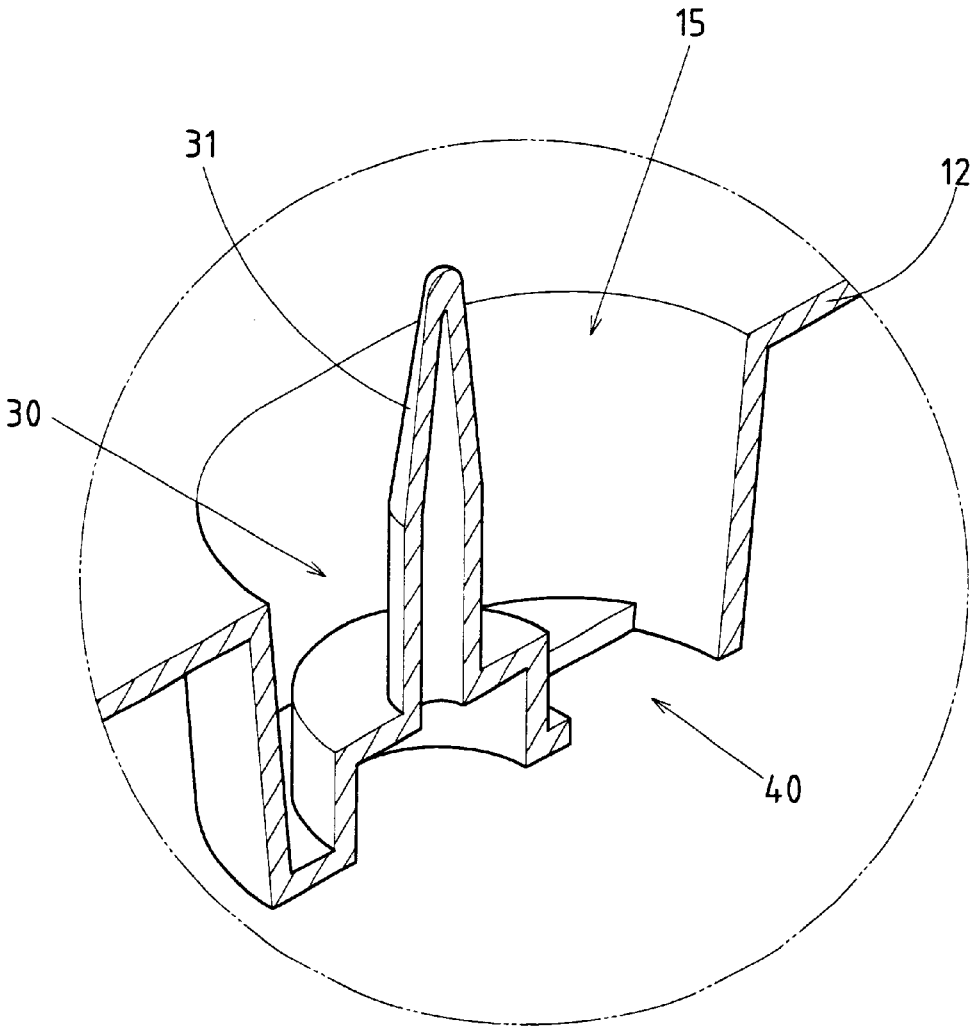
FIG. 4 shows a longitudinal sectional view of the seat and the locating projection of the preferred embodiment of the present invention.

As shown in FIGS. 1–4, a rack 10 embodied in the present invention is specifically designed to hold a plurality of pistol nozzles, each comprising a barrel 20 which is provided at a bottom end with a connection portion 21 and an adjustment knob 23. The barrel 20 is provided at a top end with a nozzle.

The rack 10 of the present invention comprises a horizontal top frame 11, a horizontal bottom frame 12, and a plurality of upright support rods 13 disposed between the top frame 11 and the bottom frame 12.

The top frame 11 is provided with a plurality of through slots 14 of a predetermined length and parallel to one another. The through slots 14 are dimensioned to accommodate the barrels 20 of the pistol-type nozzles.

The bottom frame 12 is provided with a plurality of locating slots 15, which are arranged at an interval in rows corresponding in location to the through slots 14 of the top frame 11. The locating slots 15 are provided in the bottom wall with a seat 30 and a confinement recess 40 contiguous to the seat 30. The seat 30 is provided with an upright locating projection 31 extending therefrom.

Each of the pistol nozzles is held in the rack 10 such that the barrel 20 is held in one of the through slots 14 of the top frame 11, and that the connection portion 21 of the bottom end of the barrel 20 is seated on the seat 30, and that the locating projection 31 of the seat 30 is inserted into a center hole 22 of the connection portion 21, and that the adjustment knob 23 is confined in the confinement recess 40.

The locating projection 31 of the present invention may be tapered in such a manner that it becomes smaller gradually toward the top end thereof so as to facilitate the inserting of the locating projection 31 into the center hole 22 of the connection portion 21 of the pistol nozzle.

The embodiment of the present invention described above is to be regarded in all respects as being illustrative and nonrestrictive. Accordingly, the present invention may be embodied in other specific forms without deviating from the spirit thereof The present invention is therefore to be limited only by the scopes of the following appended claims.

I claim:

1. A rack apparatus comprising:

a plurality of pistol-type nozzles, each of said plurality of pistol-type nozzles comprising:
- a barrel;
- a nozzle affixed to one end of said barrel;
- a connection portion affixed to an opposite end of said barrel, and connection portion having a center hole at and end thereof; and
- an adjustment knob contiguous to said connection portion and extending outwardly therefrom;

a top frame having a plurality of through slots formed therein, each of said plurality of through slots having a length and a width, each of said plurality of through slots extending continuously across a length of said top frame, said plurality of through slots being in spaced parallel relationship to each other;

a bottom frame having an upper surface and a lower surface, said bottom frame having a plurality of locating slots arranged in rows and spaced from each other, said rows of said plurality of locating slots being directly below said plurality of through slots respectively; and a plurality of upright support rods disposed between said top frame and said bottom frame, each of said plurality of pistol-type nozzles being positioned such that more than one barrel is received by one of said plurality of through slots in said top frame, said connection portion and said adjustment knob being received in one of said plurality of locating slots in said bottom frame, each of said plurality of locating slots having a seat formed above said lower surface thereof, said bottom frame having a locating projection extending upwardly from said bottom surface so as to have a top end positioned above said top surface, said lower surface of said bottom frame having a confinement aperture formed therethrough adjacent said seat, said seat receiving said connection portion such that said locating projection is received within said-center hole thereof, said adjustment knob having a portion extending through said confinement aperture.

2. The rack apparatus of claim 1, said locating projection tapering so as to narrow in diameter toward said top end thereof.

* * * * *